United States Patent [19]

Fujimaki et al.

[11] Patent Number: 4,600,292

[45] Date of Patent: Jul. 15, 1986

[54] PHOTOCONDUCTIVE SCREEN

[75] Inventors: Yoshihide Fujimaki; Masataka Takimoto; Hiroyuki Nomori, all of Hachioji, Japan

[73] Assignee: Konishiroku Photo Industry Co., Ltd., Tokyo, Japan

[21] Appl. No.: 593,638

[22] Filed: Mar. 26, 1984

[30] Foreign Application Priority Data

Apr. 7, 1983 [JP] Japan ..... 58-61191
Apr. 7, 1983 [JP] Japan ..... 58-61192

[51] Int. Cl.[4] ..... G03G 17/00; G03G 15/00

[52] U.S. Cl. ..... 355/3 SC; 430/53; 355/3 R

[58] Field of Search ..... 355/3 SC, 3 R; 430/53, 430/57, 68

[56] References Cited

U.S. PATENT DOCUMENTS 3,713,734 1/1973 Crane et al. ..... 355/3 R
4,141,644 2/1979 Sato et al. ..... 355/3 SC X
4,218,124 8/1980 Shinozaki et al. ..... 355/3 SC
4,286,033 8/1981 Neyhart et al. ..... 430/57 X
4,318,002 3/1982 Pressman et al. ..... 355/3 SC X
4,340,296 7/1982 Ohara et al. ..... 355/3 SC
4,394,427 7/1983 Nishikawa et al. ..... 355/3 SC X

*Primary Examiner*—A. T. Grimley
*Assistant Examiner*—C. Romano
*Attorney, Agent, or Firm*—Frishauf, Holtz, Goodman & Woodward

[57] ABSTRACT

A photoconductive screen includes a conductive screen substrate with many perforations therein, an insulating layer formed substantially on one side of the screen substrate, a biasing conductive layer substantially covering the insulating layer, and a photoconductive layer substantially covering the conductive layer. An image of electrostatic charges can be formed on the screen to control a flow of charged particles for formation of an electrostatic latent image in a chargeable layer under exposure to the flow of charged particles.

16 Claims, 40 Drawing Figures

PHOTOCONDUCTIVE SCREEN

BACKGROUND OF THE INVENTION

1. Field of the Invention

The present invention relates to a photoconductive screen having such a construction that a pattern of electrostatic charges may be formed thereon to control a flow of charged particles, for example, positive ions passing thereacross so a certain electrostatic latent image may be formed in a chargeable layer, for example, made of a dielectric or photoconductive material under exposure to the above flow of charged particles.

2. Description of the Prior Art

For example, Japanese Patent Publication No. 138734/1978 discloses a photoconductive screen 7 having a biasing layer, as shown in FIG. 1, comprising a screen substrate 1, a photoconductive layer 2 on one side thereof and an insulating layer 3 and conductive biasing layer 4 on the other side thereof. Since in the above photoconductive screen the photoconductive layer 2 and insulating layer 3 are formed on different sides of the substrate 1, it is difficult to fabricate the screen in the form of an endless drum and further there is a high possibility that the biasing layer 4 formed is in contact to the substrate 1 by accident, making biasing impossible.

More specifically, to fabricate the photoconductive screen of FIG. 1, one side of the substrate 1 is coated using a spray gun 8 to form an insulating layer 3 as in FIG. 2A. Next, aluminium or other metal is deposited on the insulating layer 3 by vacuum evaporation to form a conductive biasing layer 4 and then the other side of the substrate 1 is coated using a spray gun 9 to form a photoconductive layer 2, as shown in FIG. 2B. Accordingly, if the substrate 1 of the form of a screen drum is used and individual layers are formed while revolving the substrate as in FIG. 3, it is difficult to have a sufficient space between the substrate 1 and spray gun 8 inside in formation of the insulating layer 3 and also between the substrate 1 and an evaporation source 10 inside as hatched in the figure in evaporation to form the biasing layer 4. For this reason, the insulating layer 3 has many irregularities in thickness with inferior quality of coating. Further, since the spray solution sticks and turns around to readily come on the other side of substrate, the resultant photoconductive screen, when used, exhibits poor control of the ionic flow. In addition, because of an insufficient space from the evaporation source, when the biasing layer 4 is formed by evaporation, vaporized metal sticks and turns around to readily come on the other side of substrate 1 and deposits there. As a result, there are often formed closed circuits between this layer and substrate 1. In this case, no biasing effect can be expected.

For the reasons as mentioned above, it is very difficult to fabricate a photoconductive screen of FIG. 1 of good quality with a substrate 1 that is provided in the form of drum as in FIG. 3. Therefore, it becomes unavoidable to start with a flat piece of screen substrate 1 and form individual layers on the two sides thereof by coating and evaporation. In this case, however, since the flat screen substrate 1 poorly maintains its shape (i.e., it is liable to deformation), it is necessary to hold its four sides with a frame 11 (FIG. 4) and therefore the areas covered with the frame become ineffective. Namely, if such flat screen substrate, after formation of individual layers, is curled to a cylindrical form to provide a photoconductive screen in the form of drum, it is necessary to cut away the framed portion at least at a pair of opposite edges of substrate 1 (namely, edges that are directed along the width of formed drum) to join a pair of opposite cut ends thereof.

Further, even after a screen is shaped in the form of drum, it is not possible to directly join the opposite ends of the substrate 1, so they must be joined by means of a bonding member 12, which provides a seam that performs nothing as the photoconductive screen. This seam thus necessarily limits the position of the leading edge of the effective imaging area and copy paper. As a result, every time the drum photoconductive screen 7 turns a turn, a continuous image is formed only in a range that corresponds to a single turn of drum and therefore the copy paper supplied is practically limited in size. Namely, if the photoconductive screen 7 is turned continuously more than a single turn for image reproduction in various sizes of copy paper, the above seam appears itself as a linear stripe or stripes in the copy image. For this reason, to reproduce an image of large size in a copy paper, the drum photoconductive screen 7 used must necessarily have a correspondingly large drum diameter, which needs a copier system of large size. Further, in each copy process, the stop position of the drum screen must always be fixed relative to the seam. This requires more complicated control of the drum driving system and the drum driving system itself must be given extra motions, which prevents highspeed copy reproduction.

OBJECTS AND SUMMARY OF THE INVENTION

Accordingly, it is an object of the present invention to provide a biasing layer added photoconductive screen that can be readily fabricated in a seamless and endless form allowing a smaller design of the copier system and reproduction of copies at a higher speed and yet exhibits improved characteristics in the control of charged particle flow.

Namely, the invention is concerned with such a photoconductive screen, comprising:

(a) A conductive screen substrate having a large number of perforations;

(b) An insulating layer substantially formed on one side of such conductive screen substrate;

(c) A biasing conductive layer formed to substantially cover such insulating layer; and (d) A photoconductive layer formed to substantially cover such biasing conductive layer.

The photoconductive screen embodying the present invention is provided sequentially with a biasing conductive layer and photoconductive layer on one side of a conductive screen substrate, so these layers may be formed only on one side of such substrate. Therefore, an endless photoconductive screen, for example, in the form of drum can be very readily fabricated with uniform thickness and adhesion of individual layers to achieve favorable characteristics.

Many other features, advantages and additional objects of the present invention will be apparent to those versed in the art upon making reference to the detailed description which follows and the accompanying drawings.

BRIEF DESCRIPTION OF THE DRAWINGS

FIGS. 1 through 4 show photoconductive screens of the prior art.

More specifically, FIG. 1 is an expanded sectional view of a part of such photoconductive screen. FIGS. 2A, 2B and 3 are sectional views of the same photoconductive screen at individual steps of its fabrication process. FIG. 4 is a plan view of a flat piece of screen substrate.

FIGS. 5 through 22 refer to examples of the present invention.

More specifically, FIG. 5 is an expanded sectional view of a part of a photoconductive screen embodying the invention.

FIGS. 6, 7A, 7B and 7C are sectional views of the same photoconductive screen at individual steps of its fabrication process.

FIG. 9 is a more expanded sectional view of a part of the above photoconductive screen.

FIG. 10 is an expanded sectional view similar to FIG. 9 but referring to another photoconductive screen.

FIG. 11 is an expanded sectional view similar to FIG. 9 but referring to another photoconductive screen of the invention.

FIG. 12 is a sectional view of the photoconductive screen of FIG. 11 at a step of its fabrication process.

FIG. 13 is an expanded sectional view similar to FIG. 9 but referring to still another photoconductive screen of the invention.

FIG. 14 is a schematic sectional view of an electrophotographic copier system.

FIG. 16 is a schematic sectional view illustrating the principle of how the ionic flow is controlled by the photoconductive screen.

FIG. 17 is a schematic sectional view of an electrophotographic copier system for image reproduction in two colors.

FIGS. 18A, 18B, 19A, 19B, 19C, 19D, 19E, 20, 21A, 21B, 21C, and 22 are sectional views illustrating individual steps of a 2-color image reproduction process.

DESCRIPTION OF THE PREFERRED EMBODIMENTS

Figure 1:
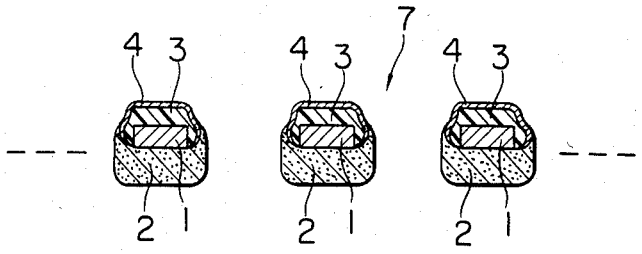
FIG. 1 PRIOR ART
Figure 2A:
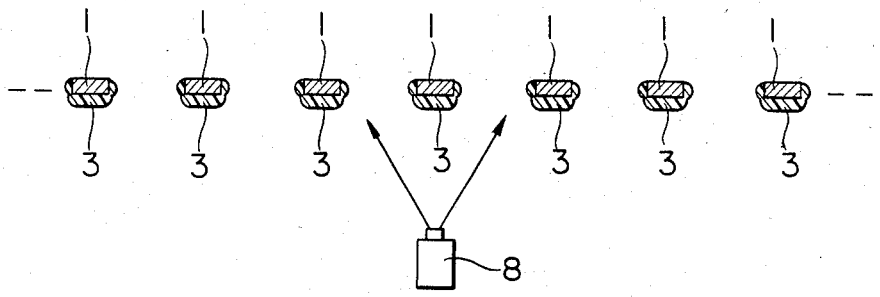
FIG. 2A PRIOR ART
Figure 2B:
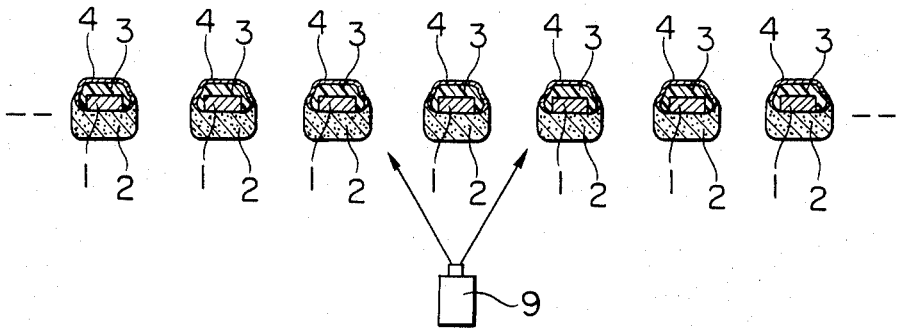
FIG. 2B PRIOR ART

First, an example of photoconductive screen embodying the invention will be described with reference to FIG. 5.

This photoconductive screen 27 is provided as a screen of 50 to 200 meshes having a large number of minute perforations 20 therein. It comprises a 20 to 100 μm thick conductive screen substrate 21, insulating layer 23 with which at least one side of such substrate is covered (in the illustrated example, the walls of perforations 20 are also covered with the same layer), conductive biasing layer 24 that is formed so as to substantially cover the above insulating layer, and photocondutive layer 22 that is formed so as to practically cover the above biasing layer.

The conductive screen 21 may be a metal mesh, for example, made of stainless steel, aluminium or nickel.

The insulating layer 23 may be composed of a polymer of addition polymerization, polyaddition or polycondensation type, for example, polyethylene, polypropylene, acrylate resin, methacrylate resin, polyvinyl chloride resin, vinyl acetate resin, epoxy resin, polyurethane resin, phenol resin, polyester resin, alkyd resin polycarbonate resin, silicon resin, or melamine resin, or it may be a copolymer composed of a combination of a plurality of monomer species used in these polymers, for example, vinyl chloride-vinyl acetate copolymer or vinyl chloride-vinyl acetate-maleic anhydride copolymer though it is not limited to the above examples but every resin that is generally used in such application can be used or an insulating material other than the resin is also applicable. The biasing layer 24 may be a coating deposited by evaporation, which can be made, for example, of aluminium.

Further, the photoconductive layer 22 may be made of selenium, selenium-tellurium, cadmium sulfide organic or other photoconductor that is generally used in such application.

In a method to fabricate the photoconductive screen 27, first, a solution to form the insulating layer is prepared according to the following formula:

Acrylic resin (DIANAL HR-116 as supplied by Mitsubishi Rayon Co., Ltd.): 8 g

Figure 6:
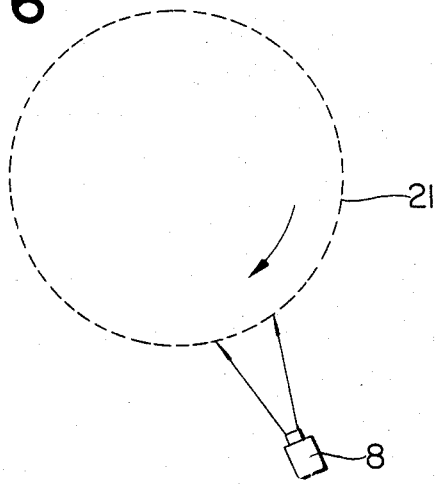
Figure 7A:
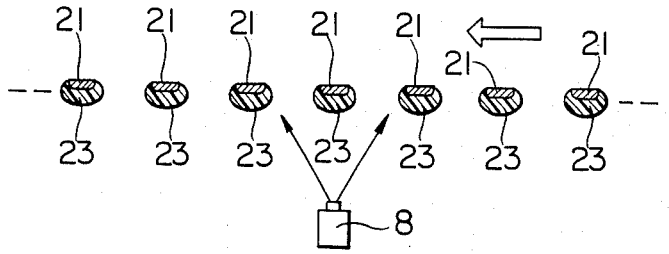

Melamine resin (SUPER BECKAMINE J-820 as supplied by Dainippon Ink & Chemicals Inc.): 2 g Toluene: 10 ml Methyl isobutyl ketone: 30 ml Cellosolve acetate: 60 ml The outside surface of a 40 μm thick drum screen substrate 21 (conductive screen) meshed at 100 pitches/inch (100 meshes) is sprayed, as shown in FIGS. 6 and 7A, with the above solution using a spray gun 8 while revolving the substrate. After drying 1 hour at 120° C., there is formed an insulating layer 23 with the maximum thickness of about 13 μm.

Figure 7B:
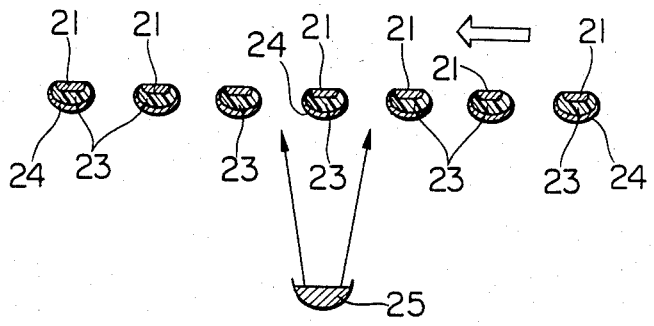

Over this insulating layer, a conductive layer 24 of aluminium is deposited 500 Å thick by vacuum evaporation from an aluminium source 25 as shown in FIG. 7B.

Figure 4:
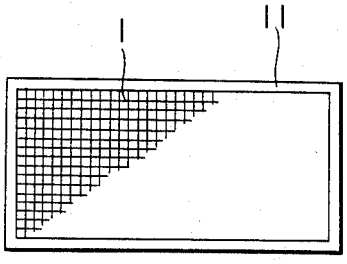
FIG. 4 PRIOR ART
Figure 7C:
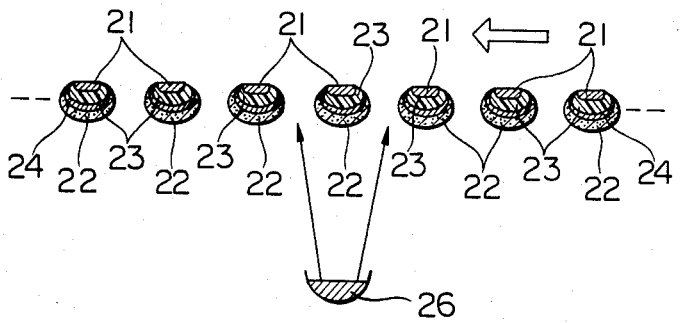
Figure 10:
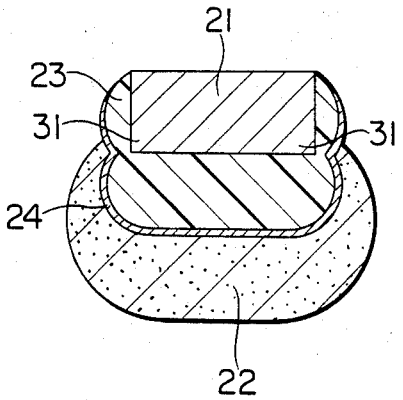

Next, as shown in FIG. 7C, 4,10-dibromoanthanthrone (C.I.593000) is vaporized from its source 26 to deposit a 0.3 μm thick carrier generating layer over the conductive layer 24.

Over the carrier generating layer, a carrier transporting layer comprising, for example, bis(4-N,N-diethylamino-2-methylphenyl)-phenylmethane and polycarbonate resin is coated with a thickness of 10 μm to obtain a photoconductive layer 22. The carrier transporting layer is formed by coating by means of a spraygun a solution containing 3.75 g of the carrier transporting material and polycarbonate resin (Panlite-L-1250 produced by Teijin chemical Co.) dissolved in 1,1,2-trichloroethane. Thus a drum photoconductive screen 27 is obtained. The photoconductive layer is constituted by coating a carrier generating layer and a carrier transporting layer in order on the conductive layer or vice versa. Also, a photoconductive single layer containing a carrier generating material, a carrier transporting material and an insulating binder can be used.

For a reason stated hereinafter, it is important that the surface of the above substrate 21 to be laminated with individual layers as mentioned above should have curved surfaces as shown in the expanded view of FIG. 9. Such curved surfaces can be formed, for example, by the following method.

Figure 8A:
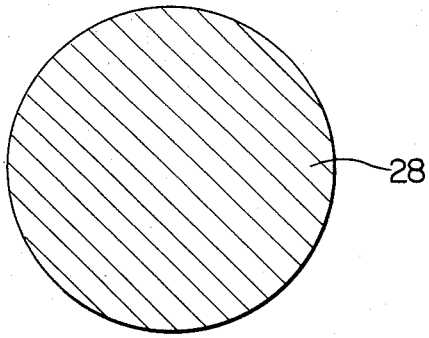
FIGS. 8A, 8B, 8C, 8D, and 8E are sectional views of a screen substrate at individual steps of its fabrication process.
Figure 8B:
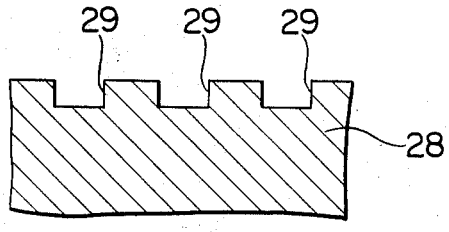

First, an electromolding substrate 28 is worked columnar as in FIG. 8A and in its outside surface a number of channels 29 are cut at certain pitches as shown in an expanded sectional view of FIG. 8B, for example, by etching so as to provide a pattern corresponding to screen meshes.

Figure 8C:
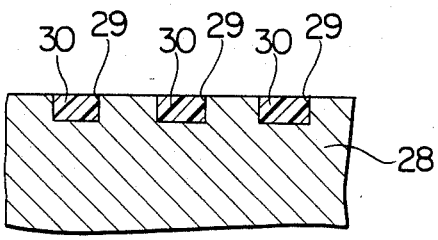

Second, the substrate 28 is coated in its whole surfaces with a resin 30 as the masking compound and it is ground to leave such compound only in the channels 29 (filling of channels) as in FIG. 8C.

Figure 8D:
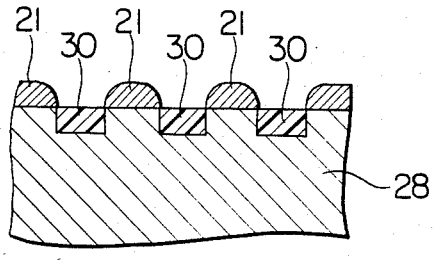

Electromolding of known art is then performed on exposed surfaces of the substrate 28 that are not covered with the resin 30, when the metal 21 deposits with curved surfaces as shown in the sectional view of FIG. 8D.

Figure 8E:
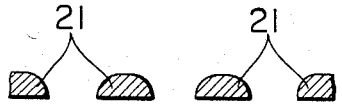

Separation of the deposited metal 21 gives a seamless screen substrate as shown in FIG. 8E.

It will be understood from the above that with the design of the photoconductive screen 27 of the present example a seamless screen substrate 21 can successively be laminated with individual layers by coating or evaporation from the outside of such substrate only, so an endless and seamless photoconductive screen can be fabricated very easily. Further, since the spray gun for spraying or the evaporation source can be disposed at a sufficient distance from the screen substrate, it is possible to supply the coating solution or vapors uniformly with a high directionality. As a result, a coating of uniform thickness is provided for the insulating layer 23 and in formation of the biasing layer 24 the vaporized metal selectively deposits on one side of the substrate only, never sticking and turning around to deposit on the backside. Therefore, no circuit is formed by accident from such biasing layer to the substrate.

Figure 9:
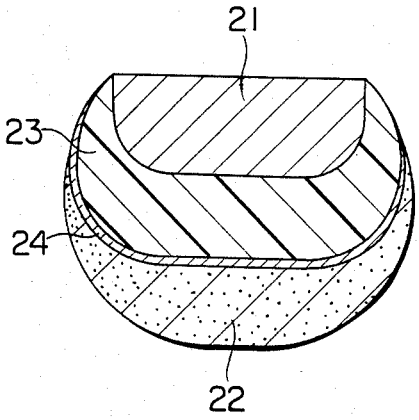

Further, it is also advantageous to uniform coating and evaporation that the substrate 21 to be laminated with individual layers as mentioned above is formed so as to have curved surfaces as shown in FIG. 9. By contrast, if a substrate 21 used has corners 31 of angles not larger than 90° as in FIG. 10 surfaces around such corners are coated poorly to result in a layer which is thinned there so much that there is a danger that in some cases the conductive layer 24 may be short-circuited to the substrate 21 at these corners during operation.

Figure 11:
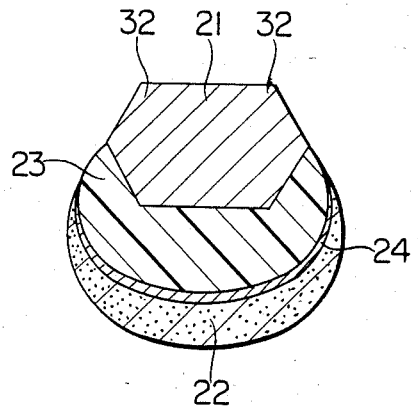
Figure 12:
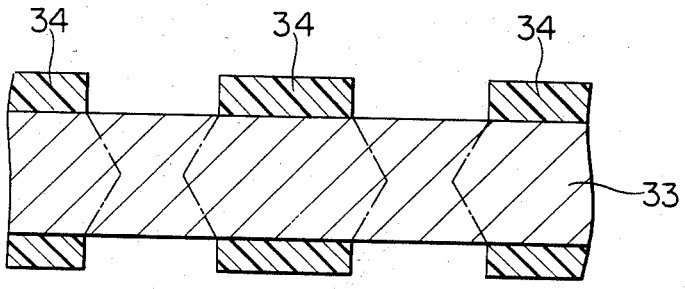
Figure 13:
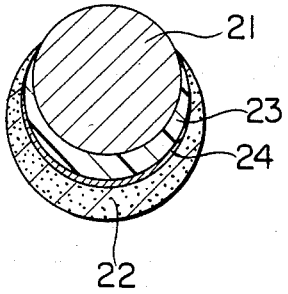

Therefore, it is preferable to form the substrate 21 so its outside surface may be curved as in FIG. 9. Even if they are cornered, obtuse angles should preferably be used as is the case with the corners 32 in FIG. 11 (namely, any angle that is not larger than 90° should be excluded). The substrate 21 of FIG. 11 can be prepared with such a method that a mask 34 is formed on both surfaces of a continuous piece of substrate material 33 in the same pattern as in FIG. 12, for example, by coating these surfaces with photoresist and by its exposure and development of known art and the substrate material in unmasked areas is etched until the material is removed in a configuration of a double truncated cone in these individual areas to have perforations as shown by interrupted lines in FIG. 12. FIG. 13 shows another version of the photoconductive screen of FIG. 9. It comprises a substrate 21 of circular cross section one side of which is laminated with individual layers as mentioned above. This substrate may be comprised of many wires that are intertwined with one another in the form of screen substrate.

It is noted that in the above examples the layers as mentioned above may individually extend partially to another side where the screen substrate is exposed as far as the extension is limited to such a range that the performance of the photoconductive screen as such may not be affected. Further, an intermediate layer or layers may be inserted as appropriate between the above layers. It is noted that after formation of the photoconductive layer another conductive layer may be deposited on the other side of the substrate.

An electrophotographic copier system that makes use of the photoconductive screen 27 of FIGS. 5 or 9 with the above carrier transport layer added will be described next with reference to FIG. 14. On top of the main body of this system, there is provided an original draft table 41 that can be driven in reciprocating motion. An original 55 is placed on such table 41 for illumination with a lamp 42. Further, there are mirrors 43 and 44, fixed lens 45 and insulator drum 53. The drum 53 is surrounded by a black color developing device 48 filled with negatively charged black toner and a cleaning device 50 to remove residual toner and charges from the surface of drum 53. A transfer drum 51 having the same diameter as the drum 53 is driven or revolves counterclockwise under contact with this drum. Beside, there are provided a transfer electrode 63 that is a corona discharge device, copy paper tray 62, copy paper feed roller 33 that feeds copy papers 52 accommodated in the copy paper tray piece by piece, first transport rollers 34 to transport each copy paper to the transfer drum 51, neutralizer 35 to neutralize the copy paper after image transfer for easier separation from the drum 51, and claw 36 to forcibly separate the copy paper from the drum 51. A fixing device 37 has a built-in heater. It is noted that actually guide plates are used, though not shown, to guide the copy paper 52.

On the one hand, on the outside of drum 53, a photoconductive screen drum 27 cylindrical in form is provided so the former faces the photoconductive layer of the latter. The drum 27 is disposed so it may start counterclockwise revolution synchronously with the original copy table 41 and drum 53. This drum 27 is surrounded by a screen charger 38 and screen neutralizer 39 that is an electroluminescent (EL) board or alternate current corona discharge device to remove residual charges from the drum 27. Inside the photoconductive screen drum 27, a charged particle source (corona discharge device) 49 to project charged particles is disposed opposite to the drum 53.

The copy process with the above photoconductive screen 27 proceeds as outlined below with reference to FIG. 15.

Figure 5:
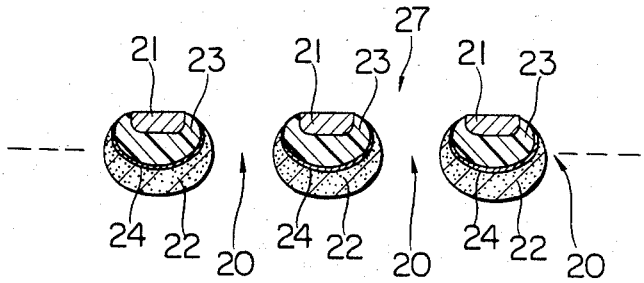
Figure 15A:
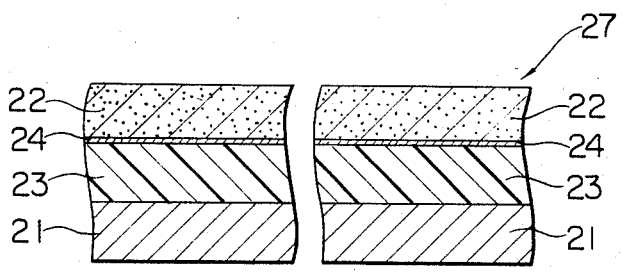
FIGS. 15A, 15B, 15C, 15D, and 15E and sectional views illustrating individual steps of a copy process.

FIG. 15A shows essential features of the photoconductive screen of FIG. 5 in an expanded sectional view, in which major component layers are formed over a conductive screen substrate 21 across a minute perforation 20 as already shown in FIG. 5 though the photoconductive screen 27 is shown upside-down as compared to FIG. 5. To ease understanding, the cross section of individual layers is shown without any hatching or dotting in FIG. 15B and subsequent figures.

Figure 15B:
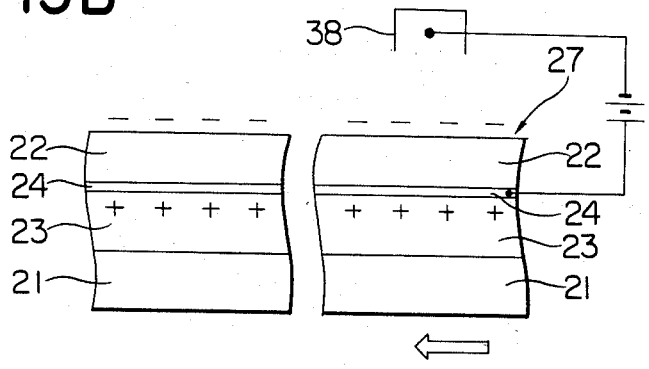

The copy process starts with exposure of the whole surface of photoconductive layer 22 of photoconductive screen 27 to corona discharges from a Scorotron type charger 38 (discharge voltage: −6 KV; grid voltage: −600 V) for uniform negative charging (for example, to −300 V) of such surface as shown in FIG. 15B.

Figure 15C:
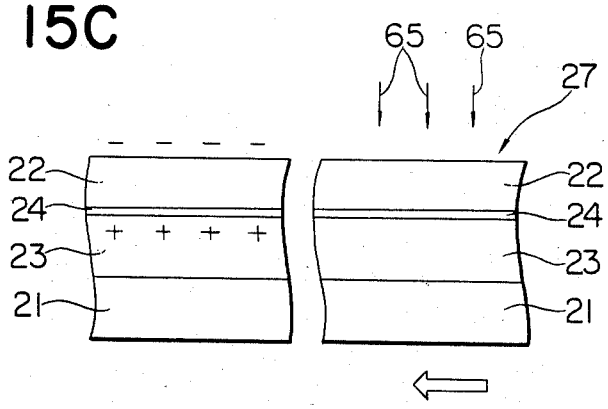

The original 55 is then exposed to a beam of light from a halogen lamp and the reflected beam 65 is led to the photoconductive layer 22 for its exposure to the original image as shown in FIG. 15C. The beam energy from the halogen lamp is adjusted to 10 lux. sec. as measured in the white background area of original. Of two types of carriers thereby generated in the photoconductive layer 22, holes neutralize negative charges in the surface for their elimination. In unexposed areas (for example, areas corresponding to black areas of the original copy), however, the negative charges remain as they are in the surface. There is thus formed a charging pattern corresponding to the original copy.

Figure 15D:
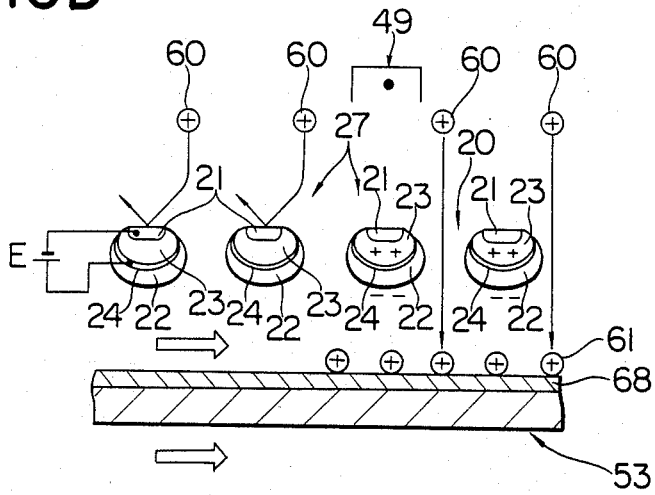
Figure 15E:
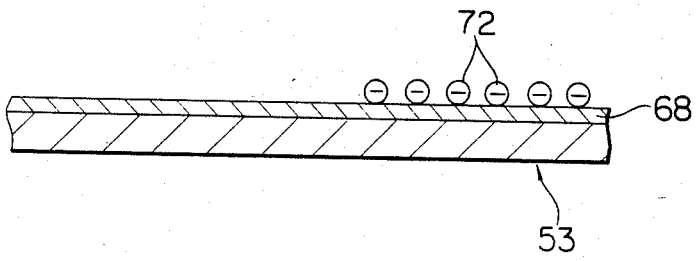
Figure 16:
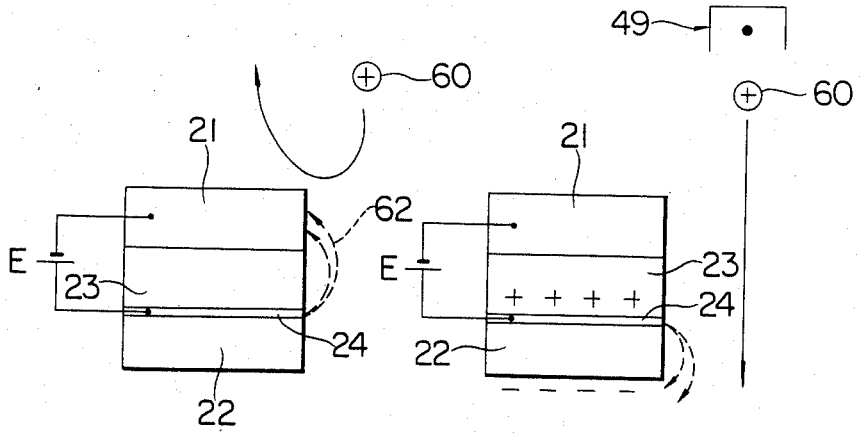

Next, as shown in FIG. 15D, the drum 53 having an insulator (or dielectric) layer 68 in its outside surface is disposed opposite to the photoconductive layer 22 of the photoconductive screen 27 at a distance of about 2 mm therefrom and a Scorotron charger 49 is disposed for the ion source in such a position that it faces the exposed surface of the conductive screen substrate 21. With a prescribed voltage (2 KV) from a power supply E applied between the biasing layer 23 and conductive screen substrate 21 for biasing, positive ions 60 are projected from the charger 49, for example, under application of a discharge voltage of 10 KV. In unexposed areas positive ions 60 are accelerated in an electric field generated by negative charges that have precipitated in the surface of photoconductive layer 22 so they may pass through minute perforations 20 that open in these areas to reach the insulator layer 68 and deposit there. Meanwhile, in exposed areas where negative charges in the photoconductive layer 22 have been lost or poorly retained, positive ions 60 are repelled and therefore cannot reach the insulating layer 68. Thus, an electrostatic latent image 61 of positive polarity is formed in a pattern that accurately corresponds to the unexposed areas of FIG. 15C.

The electrostatic latent image 61 thus formed can be brought in contact with negatively charged toner 72 as supplied from a developing device (48 of FIG. 14) for development to form a visible positive image of toner on the insulator layer 68.

The toner image can then be transferred to a copy paper by a known art and further fixed to reproduce a sharp image.

At the process step of FIG. 15D, application of a bias voltage E produces an electric field 62 in a direction reverse to the ionic flow 60 in exposed areas. Repelled in this field, ions 60 fail to pass through these areas of the photoconductive screen. By contrast, in unexposed areas where negative charges are retained in the photoconductive layer 22, an electric field 63 is produced in the same direction as the ionic flow 60 that overcomes the bias electric field, so positive ions are accelerated to pass across the photoconductive screen.

Figure 3:
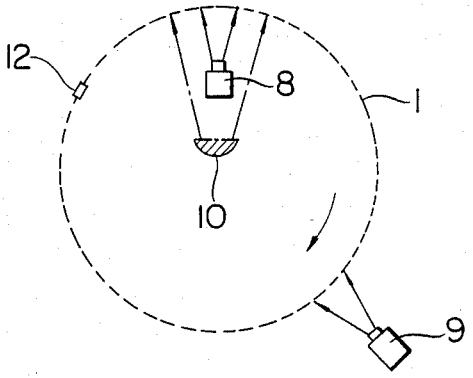
FIG. 3 PRIOR ART

In the above copy process, the photoconductive screen 27 is provided in the form of seamless and endless drum. In contrast to the example of FIG. 3, therefore, the copy process can be started at an arbitrary position of the photoconductive screen and a plurality of copy processes can be continuously repeated as necessary. Therefore, adjustments are possible to various sizes of image and copy paper. As a result, it is possible to use a drum photoconductor screen 27 of smaller diameter, which allows a smaller design of the entire copier system and easier control of its driving system for operation at higher speed.

It is noted that the ionic flow control characteristic as mentioned above wherein ions are checked from passage by the potential difference between the biasing layer 24 and substrate 21 is as good as when a photoconductive layer and biasing layer are provided on the surface and back, respectively, of the screen substrate (example of FIG. 1).

Next, the above photoconductive screen 27 can be applied to reproduction of a multi-color image in a process as described below. For simplification, the following explanation will be limited to reproduction of a two-color image that has a black image zone and red image zone on white background.

Figure 17:
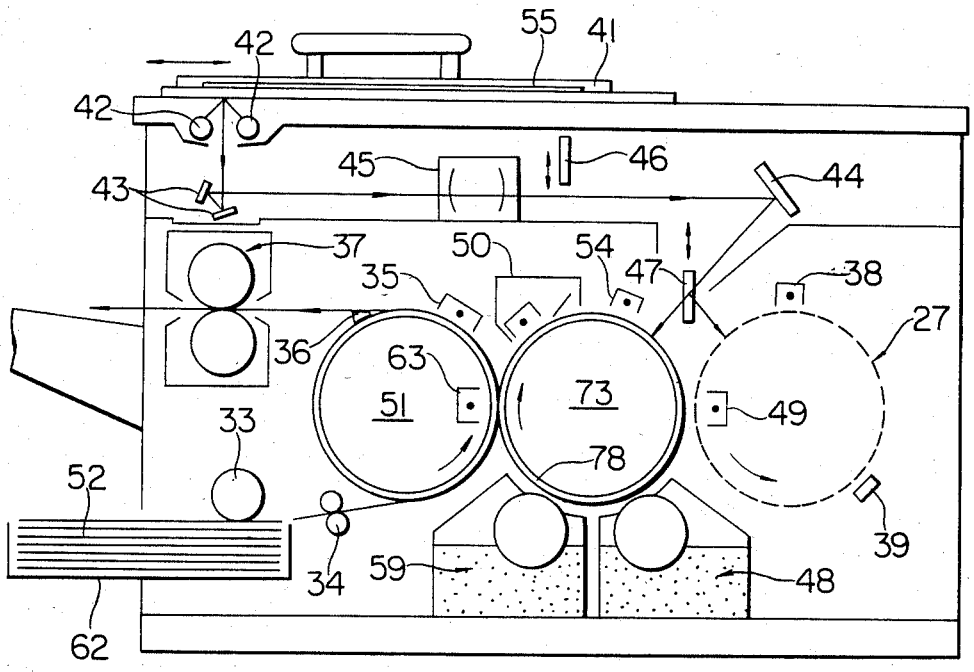

FIG. 17 is an example of the electrophotographic copier system to be used for reproduction of a two-color image according to the present invention.

Figure 14:
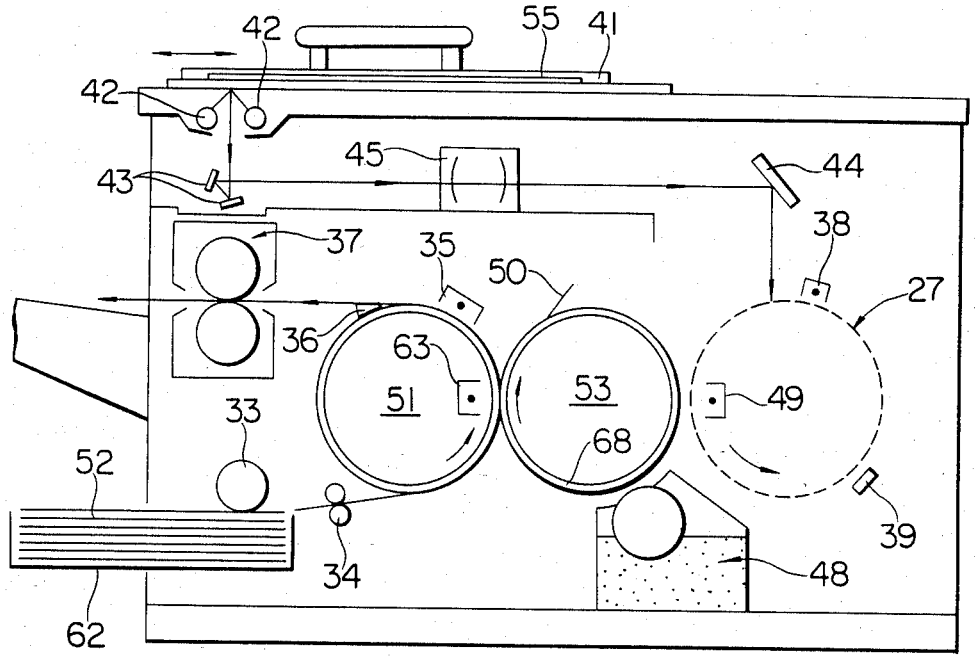

In this copier system, there are additional means that are not used in the system of FIG. 14, namely, a red filter 46 that can be retractably moved in the optical path, and a dichroic filter 47 that can also be retractably moved in the optical path to reflect the red spectral component of beam but pass its complement cyan spectral component. In FIG. 17, the dichroic filter 47 is disposed in the optical path with the red filter 46 retracted therefrom. In the surface of photoreceptor drum 73, a photoconductive layer 78 is provided, which is charged uniform under exposure to discharges from the charger 54 as the photoreceptor revolves clockwise. This photoconductive layer is composed of selenium, organic semiconductor, or the like.

The photoreceptor 73 is surrounded by a charger 54 to charge the photoconductive layer 78 uniform, developing device 48 containing black toner of positive polarity, and another developing device 59 containing red toner also of positive polarity.

On the copier system of FIG. 17, the two-color copy process proceeds in the following way.

Figure 18A:
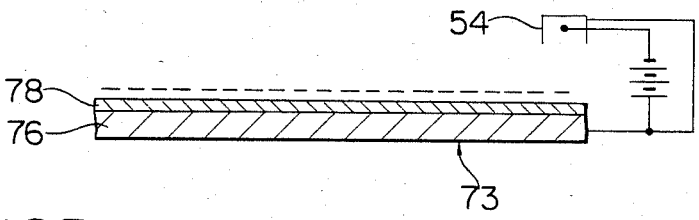
Figure 18B:
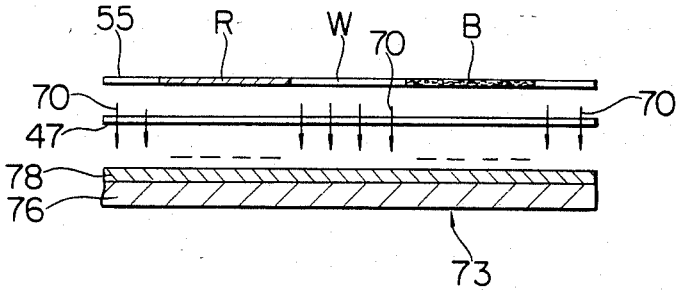

With an electrostatic latent image carrier (photoreceptor) 73 comprising a conductive base 76 and photoconductive layer 78, for example, selenium-tellurium based photoconductor layer formed thereon, a voltage is applied between the base 76 and charger 54 for uniform negative charging of the photoconductive layer 78 as shown in FIG. 18A. Next, a photoimage of an original 55 that has a black image zone B and red image zone R is projected through a cyan color filter 47, filter of a color that is complementary to the red color onto the photoconductive layer 78 as shown in FIG. 18B. The cyan color filter used herein is an optical means that passes the spectral component corresponding to the cyan color only. As a result, the photoconductive layer 78 is exposed to light to lose electrostatic charges precipitated thereon except those areas that correspond to the black image zone B and red image zone R. Thus, there is formed a first electrostatic latent image that comprises negative electrostatic charges retained only in the above areas. In the figure, arrows 70 indicate the incident beam.

Meanwhile, the drum photoconductive screen 27 is pretreated, before the process step of FIG. 18B, in the following manner.

Figure 19A:
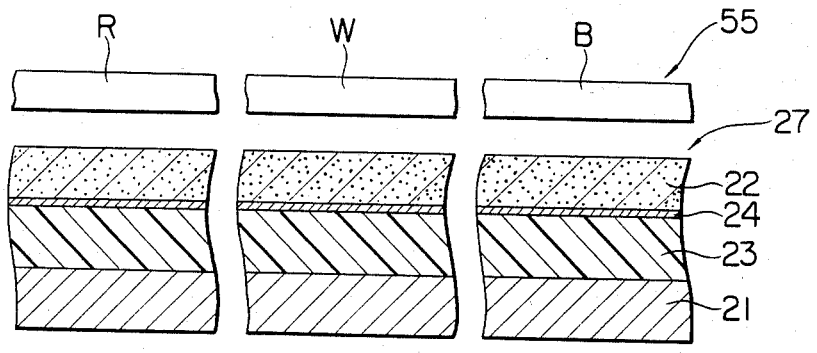
Figure 19B:
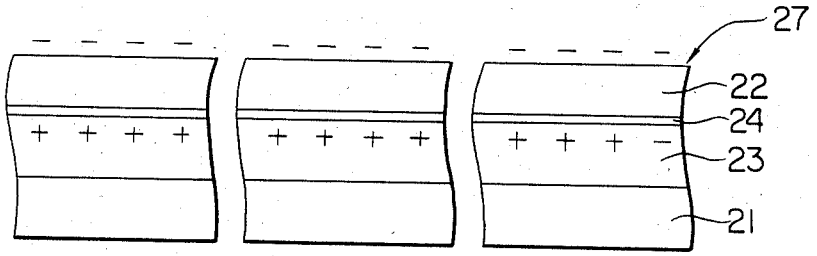
Figure 19C:
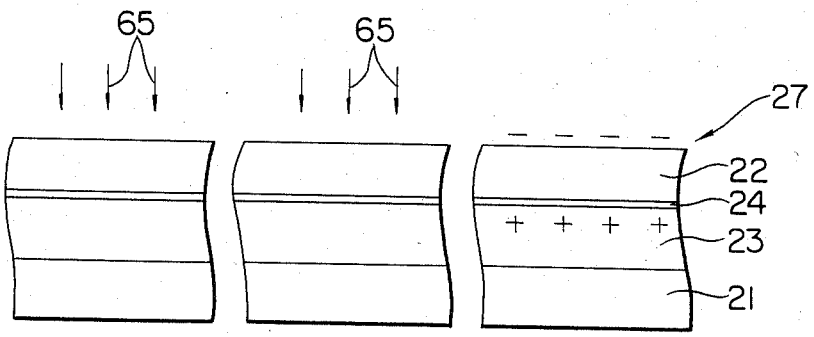

The drum photoconductive screen 27 of FIG. 19A, which corresponds to FIG. 15A, is treated for negative charging as shown in FIG. 19B using a charger 38 of FIG. 17. Further, at the same timing as the process step of FIG. 18B, the beam 65 reflected from the cyan color filter 47, namely, beam reflected from the red image zone R and white image zone W are projected onto the corresponding areas of photoconductive screen to leave negative charges in the unexposed area thereof only as shown in FIG. 19C.

Figure 19D:
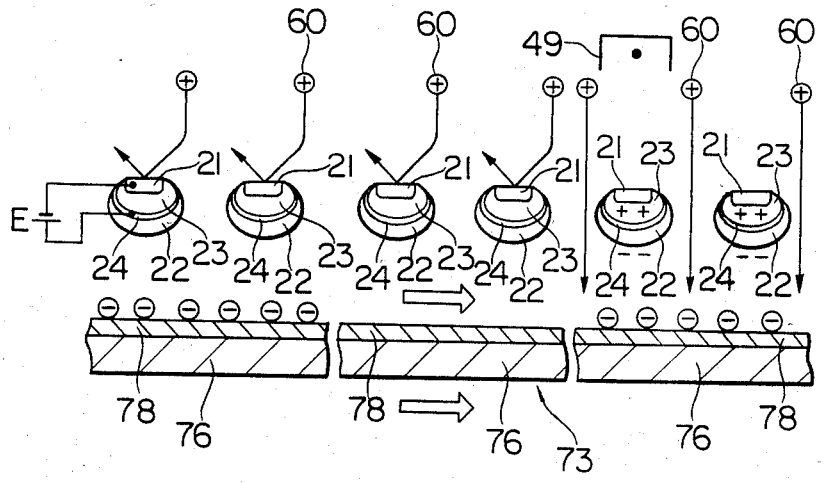
Figure 19E:
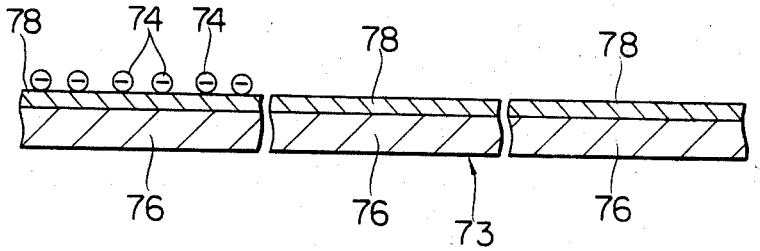

Next, it is seen from FIG. 19D that, when projected in the same configuration as in FIG. 15D, positive ions 60 pass across only such area of the photoconductive screen 27 that is charged negative, namely, area that corresponds to the black image zone of original 55 to reach the photoconductive layer 78 for selective neutralization of negative charges that have precipitated there in the process step of FIG. 18B. In other areas where ions 60 have not reached, negative charges are retained to give a certain pattern. A negatively charged electrostatic latent image 74 is thus formed in correspondence to the red image zone R as shown in FIG. 19E.

Figure 20:
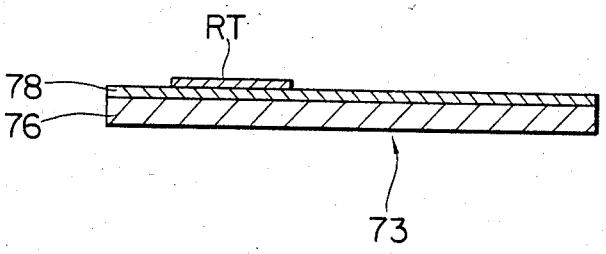

There is thus formed an electrostatic latent image with the black image zone erased, which comprises negative charges retained only in the area of photoconductive layer 78 that corresponds to the red image zone R. Development of this electrostatic latent image with red toner reproduces the red image zone RT in the photoreceptor 73 as shown in FIG. 20.

Figure 21A:
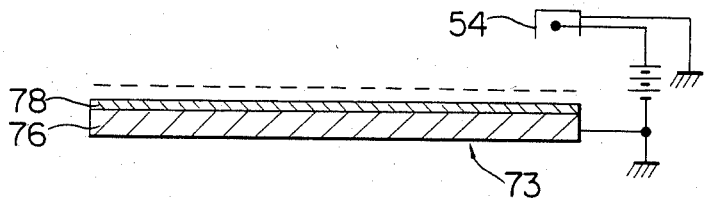
Figure 21B:
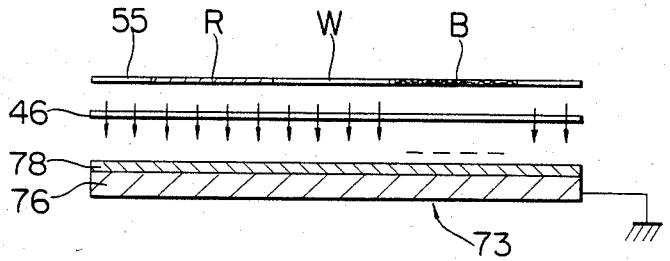
Figure 21C:
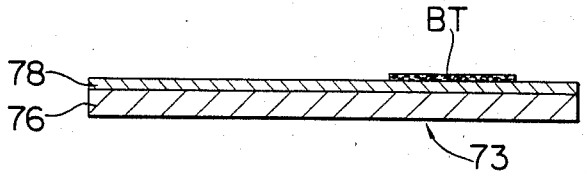

On the other hand, the black image zone B of original 55 can be reproduced by a separate process step to form the black image zone. Namely, as shown in FIG. 21A, the photoconductive layer 78 of photoreceptor 73 is uniformly charged negative by the charger 54 and then, as shown in FIG. 21B, the photoimage of the original 55 is projected onto the photoconductive layer 78 across the red color filter 46 to form an electrostatic latent image comprising negative charges only in the area that corresponds to the black image zone B of original 55. Its development with black toner thus reproduces the black image zone BT as in FIG. 21C.

Figure 22:
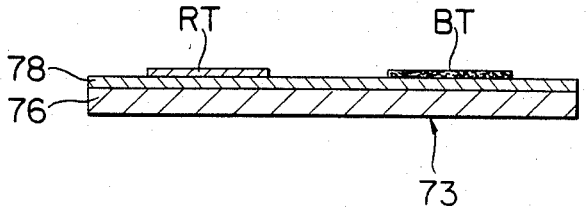

A two-color copy image having a black image zone B and red image zone R in correspondence to the original 55 can thus be reproduced as in FIG. 22. It will be understood that the above process can be achieved by combination of a process of reproducing the red image zone RT only as shown in FIGS. 18 through 20 and a process of reproducing the black image zone BT only as illustrated by way of example in FIG. 21.

It is noted that the aforementioned copy process does not require simultaneous execution of charging and exposure. Even when a photoconductive layer of low carrier transport capacity, for example, made of an organic photoconductor is used, therefore, the Carlson process of ordinary use can be applied to assure a satisfactorily high sensitivity. Further, since the voltage control is comparatively simple, voltages can readily be set to prescribed levels to achieve high sensitivity of the photoconductive layer. Moreover, since requiring only a single photoconductive layer, the photoconductive screen is less liable to the effects of residual potential and potential charges due to fatigues. In addition, since the copy process of known art can be used, high practical applicability is expected.

While a preferred embodiment of the present invention has been described, many modifications and variations thereto may be made without departing from the spirit and scope of the invention. For example, the polarity of charging of the above photoconductive screen and chargeable layer (dielectric or photoconductive layer) of the photoreceptor as well as the polarity and type of toner for development can be changed as adequate. Further, the process of reproducing the black image zone and the red image zone may be revrsed in timing sequence. In addition, the photoconductive screen can be provided in various forms, such as a endless belt or sheet, beside a drum. It is noted that the invention is not limited to reproduction of an image in either or both of the above two colors but it is applicable to reproduction of an image in any of other colors or even to a multi-color image in an arbitrary combination of the above and other colors.

What is claimed is:

1. A photoconductive screen, comprising:

a conductive screen substrate with many perforations therein, said conductive screen substrate being a seamless and endless rotatable loop;

an insulating layer formed substantially on one side of said screen substrate; the surface of said screen substrate on said one side thereof not having any adjacent surface portions defining an angle of 90° or less therebetween;

a biasing conductive layer substantially covering said insulated layer and formed substantially only on said one side of said screen substrate without contacting the opposite side of said screen substrate so as not to short-circuit to said screen substrate; and a photoconductive layer substantially covering said conductive layer;

wherein an electrostatic image can be formed on said photoconductive screen so as to control a flow of charged particles for formation of an electrostatic latent image on a chargeable layer thereof.

2. A photoconductive screen as claimed in claim 1, wherein said conductive screen substrate is a seamless and endless drum.

3. A photoconductive screen as claimed in claim 1, wherein the surface of said conductive screen substrate on said one side thereof is curved.

4. A photoconductive screen as claimed in claim 1, wherein said conductive screen substrate is electromolded.

5. A photoconductive screen as claimed in claim 1, wherein said photoconductive screen is formed in 50 to 200 mesh.

6. A photoconductive screen as claimed in claim 1, wherein said conductive screen substrate has a thickness of 20 to 100 μm.

7. A photoconductive screen as claimed in claim 1, wherein said conductive screen substrate is a metal mesh.

8. A photoconductive screen as claimed in claim 1, wherein said insulating layer is an addition polymerization type resin, or a polyaddition type resin or a polycondensation type resin.

9. A photoconductive screen as claimed in claim 1, wherein said biasing conductive layer is an evaporation film.

10. A photoconductive screen as claimed in claim 1, wherein said photoconductive layer comprises selenium, or selenium-teliurium cadmium sulfide or organic photoconductor.

11. A photoconductive screen as claimed in claim 1, wherein said photoconductive layer comprises a carrier generating material and a carrier transporting material.

12. A photoconductive screen as claimed in claim 1, wherein said photoconductive layer comprises a carrier generating material containing layer and a carrier transporting material containing layer.

13. A photoconductive screen as claimed in claim 8, wherein said biasing conductive layer is an evaporation film.

14. A photoconductive screen as claimed in claim 13, wherein said photoconductive layer comprises selenium, or selenium-teliurium cadmium sulfide or organic photoconductor.

15. A photoconductive screen as claimed in claim 13, wherein said photoconductive layer comprises a carrier generating material and a carrier transporting material.

16. A photoconductive screen as claimed in claim 13, wherein said photoconductive layer comprises a carrier generating material containing layer and a carrier transporting material containing layer.

* * * * *